US010720707B2

(12) United States Patent
Tombak et al.

(10) Patent No.: US 10,720,707 B2
(45) Date of Patent: Jul. 21, 2020

(54) RECONFIGURABLE PATCH ANTENNA AND PHASED ARRAY

(71) Applicant: Qorvo US, Inc., Greensboro, NC (US)

(72) Inventors: Ali Tombak, Cary, NC (US); Marcelo Jorge Franco, Summerfield, NC (US); Edward T. Spears, Stokesdale, NC (US)

(73) Assignee: Qorvo US, Inc., Greensboro, NC (US)

( * ) Notice: Subject to any disclaimer, the term of this patent is extended or adjusted under 35 U.S.C. 154(b) by 22 days.

(21) Appl. No.: 16/161,543

(22) Filed: Oct. 16, 2018

(65) Prior Publication Data

US 2019/0140353 A1 May 9, 2019

Related U.S. Application Data

(60) Provisional application No. 62/583,195, filed on Nov. 8, 2017.

(51) Int. Cl.

| | |
|---|---|
| ***H01Q 9/04*** | (2006.01) |
| ***H01Q 21/06*** | (2006.01) |
| ***H01Q 7/00*** | (2006.01) |
| *H01Q 19/00* | (2006.01) |

(52) U.S. Cl.

CPC ..... *H01Q 9/0442* (2013.01); *H01Q 7/005* (2013.01); *H01Q 9/045* (2013.01); *H01Q 21/065* (2013.01); *H01Q 19/005* (2013.01)

(58) Field of Classification Search

CPC .... H01Q 9/045; H01Q 9/0442; H01Q 21/065; H01Q 19/005; H01Q 7/005

See application file for complete search history.

(56) References Cited

U.S. PATENT DOCUMENTS 5,578,976 A 11/1996 Yao
6,501,427 B1 * 12/2002 Lilly ..... H01Q 1/38 333/33
2007/0030101 A1 2/2007 Mizutani (Continued)

FOREIGN PATENT DOCUMENTS

JP 2007142721 A * 6/2007

OTHER PUBLICATIONS

Aftab, N, et al., "Reconfigurable Patch Antenna for Wireless Applications," 9th European Conference on Antennas and Propagation, Lisbon, 2015, pp. 1-3.

(Continued)

*Primary Examiner* — Dieu Hien T Duong

(74) *Attorney, Agent, or Firm* — Withrow & Terranova, P.L.L.C.

(57) ABSTRACT

The present disclosure relates to a reconfigurable patch antenna, which includes a substrate, a ground plane formed on a bottom surface of the substrate or within the substrate, a primary patch, an extension patch, and switching components. The primary patch and the extension patch are formed on a top surface of the substrate and are placed parallel to each other. Herein, a gap is formed between the primary patch and the first extension patch. The switching components are formed across the gap, electrically coupled to both the primary patch and the extension patch, and configured to connect the primary patch to the extension patch or disconnect the primary patch from the extension patch.

20 Claims, 10 Drawing Sheets

(56) References Cited

U.S. PATENT DOCUMENTS

| | | | | |
|---|---|---|---|---|
| 2008/0088510 | A1* | 4/2008 | Murata | H01Q 3/24 343/700 MS |
| 2008/0100399 | A1 | 5/2008 | Atsumo et al. | |
| 2008/0299897 | A1 | 12/2008 | Mohebbi | |
| 2010/0194476 | A1 | 8/2010 | Drogi et al. | |
| 2011/0260780 | A1 | 10/2011 | Granger-Jones et al. | |
| 2012/0081262 | A1 | 4/2012 | Tanaka et al. | |
| 2014/0179241 | A1 | 6/2014 | Aggarwal et al. | |
| 2015/0303982 | A1 | 10/2015 | Yang et al. | |
| 2016/0173063 | A1 | 6/2016 | Han et al. | |
| 2016/0285447 | A1 | 9/2016 | Krishnamurthi et al. | |
| 2017/0214418 | A1 | 7/2017 | Rozek et al. | |
| 2018/0204101 | A1 | 7/2018 | De Jongh et al. | |
| 2018/0254751 | A1 | 9/2018 | Benson | |

OTHER PUBLICATIONS

Arcioni, P., et al., "A Novel Low Reflection-Loss MEMS Reconfigurable Patch Antenna," Proceedings of the 10th European Conference on Wireless Technology, Munich, 2007, pp. 257-260.

Asadallah, F. A., et al., A Digitally Tuned Reconfigurable Patch Antenna for IoT Devices, IEEE International Symposium on Antennas and Propagation & USNC/URSI National Radio Science Meeting, San Diego, California, 2017, pp. 917-918.

Bhattacharya, A., et al., "Frequency Reconfigurable Patch Antenna Using PIN Diode at X-Band," IEEE 2nd International Conference on Recent Trends in Information Systems, Kolkata, 2015, pp. 81-86.

Enayati, Amin, et al., "RF-MEMs-based Millimeter-wave Switch for Integrated Antenna Applications," Proceedings of the 5th European Conference on Antennas and Propagation, Apr. 2011, IEEE, pp. 2246-2249.

Haider, N., et al., "L/S-Band Frequency Reconfigurable Multiscale Phased Array Antenna with Wide Angle Scanning," IEEE Transactions on Antennas and Propagation, vol. 65, Issue 9, Sep. 2017, pp. 4519-4528.

Priya, C., et al., "A Novel Cram of Reconfigurable Patch Antenna Using RF MEMS," International Conference on Emerging Trends in VLSI, Embedded System, Nano Electronics and Telecommunication System, Tiruvannamalai, 2013, pp. 1-5.

Non-Final Office Action for U.S. Appl. No. 16/161,454, dated Feb. 26, 2019, 8 pages.

Non-Final Office Action for U.S. Appl. No. 16/161,436, dated May 10, 2019, 8 pages.

Notice of Allowance for U.S. Appl. No. 16/161,454, dated Apr. 2, 2019, 9 pages.

Final Office Action for U.S. Appl. No. 16/161,436, dated Jul. 26, 2019, 9 pages.

Non-Final Office Action for U.S. Appl. No. 16/161,444, dated Jul. 1, 2019, 21 pages.

Corrected Notice of Allowance for U.S. Appl. No. 16/161,454, dated Jun. 3, 2019, 6 pages.

Notice of Allowance for U.S. Appl. No. 16/161,436, dated Oct. 30, 2019, 9 pages.

Final Office Action for U.S. Appl. No. 16/161,444, dated Nov. 21, 2019, 9 pages.

U.S. Appl. No. 16/161,436, filed Oct. 16, 2018.

U.S. Appl. No. 16/161,444, filed Oct. 16, 2018.

U.S. Appl. No. 16/161,454, filed Oct. 16, 2018.

* cited by examiner

RECONFIGURABLE PATCH ANTENNA AND PHASED ARRAY

RELATED APPLICATIONS

This application claims the benefit of provisional patent application Ser. No. 62/583,195, filed Nov. 8, 2017, the disclosure of which is hereby incorporated herein by reference in its entirety.

This application is related to U.S. Pat. No. 10,594,357, issued Mar. 17, 2020, and titled RADIO FREQUENCY SWITCH SYSTEM, which claims benefit of provisional patent application No. 62/582,704, filed Nov. 7, 2017; U.S. Patent Application Publication No. 20019/140687, published May 9, 2019, and titled RADIO FREQUENCY SWITCH BRANCH CIRCUITRY, which claims benefit of provisional patent application Ser. No. 62/582,714, filed Nov. 7, 2017; and U.S. Pat. No. 10,389,400, issued Aug. 20, 2019, and titled RADIO FREQUENCY SWITCH CIRCUITRY, which claims benefit of provisional patent application Ser. No. 62/582,704, filed Nov. 7, 2017, the disclosures of which are hereby incorporated herein by reference in their entireties.

FIELD OF THE DISCLOSURE

The present disclosure relates to a patch antenna and a phased array formed by a number of the patch antennas, and more particularly to a reconfigurable patch antenna and a reconfigurable phased array formed by a number of the reconfigurable patch antennas.

BACKGROUND

As the capacity of the current cellular wireless networks is being reached, new frequency bands are introduced and respective wireless standards are being developed. 5G is one of those wireless standards where the majority of the newly introduced spectrum lies in the mmWave such as at 28, 38, or 66 GHz. Because of the steep attenuation characteristics at mmWave, mmWave 5G communication systems will most likely be line of sight (LOS), which will use phased arrays and direct the beam towards the base station/user equipment. As such, the power can be localized towards the receiver/transmitter and the power-noise figure requirements would be relieved on individual devices.

A phased array is essentially a group of antennas which have a same resonant frequency and are excited with a phase difference in between the adjacent elements that steer the beam to the desired direction. In recent years, patch antennas are gaining in popularity to form the phased array due to their low cost, easy fabrication process (may utilize conventional printed circuit board techniques in conjunction with other circuitry), and reasonable performance.

FIG. 1A shows a conventional patch antenna construction and probe-fed feeding scheme. A patch antenna 10 includes a patch 12, a substrate 14, a ground plane 16, a feed probe 18, and a feedline 20. The patch 12 is formed on a top surface of the substrate 14, while the ground plane 16 is formed on a bottom surface of the substrate 14. The feedline 20 is at the bottom surface of the substrate 14 (separate from the ground plane 16) and coupled to the patch 12 through the feed probe 18. An inner point of the patch 12, to which the feed probe 18 is touched and a radio frequency (RF) signal is provided, is a feed point F, which determines the input impedance for the patch antenna 10.

FIG. 1B shows a top view of the patch 12 with current distribution. The patch 12 has a width W and a length L orthogonal to the width W. The feed point F is centered along the width W of the patch 12 and off-centered along the length L of the patch 12. The current on the patch 12 mostly flows along a dimension, along which the feed point F is off-centered. Herein, the current on the patch 12 flows along the length L of the patch 12. For a given size of the patch 12, Eq. 1 represents the frequency the patch antenna 10 will resonate and radiate.

$$f_R \approx \frac{c}{2L\sqrt{\varepsilon_r \varepsilon_0 \mu_0}} \tag{1}$$

where c is the speed of light, L is the length of the patch 12, $\varepsilon_0$ and $\mu_0$ are the free space permittivity and permeability, respectively, and $\varepsilon_r$ is the effective relative permittivity.

A major drawback of the patch antenna 10 is the limited bandwidth. Typically, the patch antenna 10 only resonates at one frequency, which is determined by its dimensions and the substrate 14, on which the patch antenna 10 resides. As such, to implement phased arrays with different resonant frequencies, different sets of patch antennas are required, which is significantly area consuming. Therefore, there is a need for an improved antenna design, which could utilize the advantages of the patch antennas and provide tunable resonant frequencies using a same hardware.

SUMMARY

The present disclosure relates to a reconfigurable patch antenna, which includes a substrate, a ground plane, a primary patch, a first extension patch, and at least one first switching component. The primary patch and the first extension patch are formed on a top surface of the substrate, while the ground plane is formed on the bottom surface of the substrate or within the substrate. Herein, the primary patch has a width along a Y axis and a length along an X axis that is orthogonal to the Y axis. An origin point of X-Y axes is centered along both the width and the length of the primary patch. In addition, the primary patch has a feed point configured to receive a radio frequency (RF) signal. The feed point is centered along the width of the primary patch, and off-centered along the length of the primary patch. The first extension patch is parallel to the primary patch, and a first gap is formed between the first extension patch and the primary patch. The at least one first switching component is formed across the first gap, electrically coupled to both the primary patch and the first extension patch, and configured to connect the primary patch to the first extension patch or disconnect the primary patch from the first extension patch.

In one embodiment of the reconfigurable patch antenna, the at least one first switching component is one of a single pole single throw (SPST) switch, a silicon on insulator (SOI) switch, a microelectromechanical systems (MEMS) switch, a mechanical switch, and a PIN diode switch.

In one embodiment of the reconfigurable patch antenna, the at least one first switching component includes a single switch.

In one embodiment of the reconfigurable patch antenna, the at least one first switching component includes a number of switches.

In one embodiment of the reconfigurable patch antenna, the first extension patch has a width along the Y axis and a length along the X axis. The width of the primary patch and the width of the first extension patch have essentially a same value. The width of the first extension patch is symmetrical in respect to the X axis. The at least one first switching component is formed along the X axis.

In one embodiment of the reconfigurable patch antenna, the at least one first switching component includes a first switching component on the X axis.

In one embodiment of the reconfigurable patch antenna, the at least one first switching component includes a first switching component off the X axis.

In one embodiment of the reconfigurable patch antenna, the at least one first switching component includes two first switching components, which are located symmetrically in respect to the X axis.

In one embodiment of the reconfigurable patch antenna, the at least one first switching component resides over the top surface of the substrate.

In one embodiment of the reconfigurable patch antenna, both the at least one first switching component and the ground plane are formed on the bottom surface of the substrate and separate from each other. Herein, the primary patch and the first extension patch are coupled to the at least one first switching component by substrate vias, which extend through the substrate.

In one embodiment of the reconfigurable patch antenna, the at least one first switching component is formed on the bottom surface of the substrate and the ground plane is formed within the substrate. Herein, the primary patch and the first extension patch are coupled to the at least one first switching component by substrate vias, which extend through the substrate and are separate from the ground plane.

According to another embodiment, the reconfigurable patch antenna further includes a second extension patch and at least one second switching component. Herein, the second extension patch is formed over the top surface of the substrate, parallel to the primary patch, and opposite to the first extension patch. There is a second gap formed between the second extension patch and the primary patch. The at least one second switching component is formed across the second gap, electrically coupled to both the primary patch and the second extension patch, and configured to connect the primary patch to the second extension patch or disconnect the primary patch from the second extension patch.

In one embodiment of the reconfigurable patch antenna, the first gap and the second gap have essentially a same size.

In one embodiment of the reconfigurable patch antenna, the feed point is centered along the width of the primary patch and off-centered along the length of the primary patch. Herein, the first extension patch has a width along the Y axis and a length along the X axis, while the second extension patch has a width along the Y axis and a length along the X axis. The width of the primary patch, the width of the first extension patch, and the width of the second extension patch have essentially a same value. The width of the first extension patch is symmetrical in respect to the X axis, and the width of the second extension patch is symmetrical in respect to the X axis. The at least one first switching component and the at least one second switching component are formed along the X axis.

In one embodiment of the reconfigurable patch antenna, the length of the primary patch, the length of the first extension patch, and the length of the second extension patch are different from each other.

In one embodiment of the reconfigurable patch antenna, the length of the first extension patch is essentially the same as the length of the second extension patch, and different from the length of the primary patch.

In one embodiment of the reconfigurable patch antenna, the at least one first switching component includes a first port terminal coupled to the primary patch, a second port terminal coupled to the first extension patch, a switch branch, and control signal decoupling circuitry. The switch branch has a first branch terminal coupled to the first port terminal, a branch control terminal, and a second branch terminal coupled to the second port terminal. Herein, the switch branch is configured to pass an RF signal between the first branch terminal and the second branch terminal in an on-state and block the RF signal from passing between the first branch terminal and the second branch terminal in an off-state in response to a control signal that is coupled with the RF signal and received at the first port terminal. The control signal decoupling circuitry has a control signal input terminal coupled to the first port terminal to receive the control signal coupled to the RF signal, and a control signal output terminal coupled to the branch control terminal. Herein, the control signal decoupling circuitry is configured to decouple the control signal from the RF signal and provide the control signal to the branch control terminal.

In one embodiment of the reconfigurable patch antenna, the at least one first switching component includes a first port terminal, a second port terminal, a control voltage input terminal, a ground voltage terminal, and a switch branch. Herein, the first port terminal is coupled to the primary patch and the second port terminal is coupled to the first extension patch, while the control voltage input terminal and the ground voltage terminal are not coupled to the primary patch or the first extension patch. The first port terminal is configured to receive an RF signal from the primary patch, the second port terminal is configured to transmit the RF signal to the first extension patch, the control voltage input terminal is configured to receive a control signal, and the ground voltage terminal is grounded. The switch branch has a first branch terminal coupled to the first port terminal, and a second branch terminal coupled to the second port terminal. The switch branch is configured to pass the RF signal between the first branch terminal and the second branch terminal in an on-state and block the RF signal from passing between the first branch terminal and the second branch terminal in an off-state in response to the control signal received at the control voltage input terminal.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

Figure 1A:
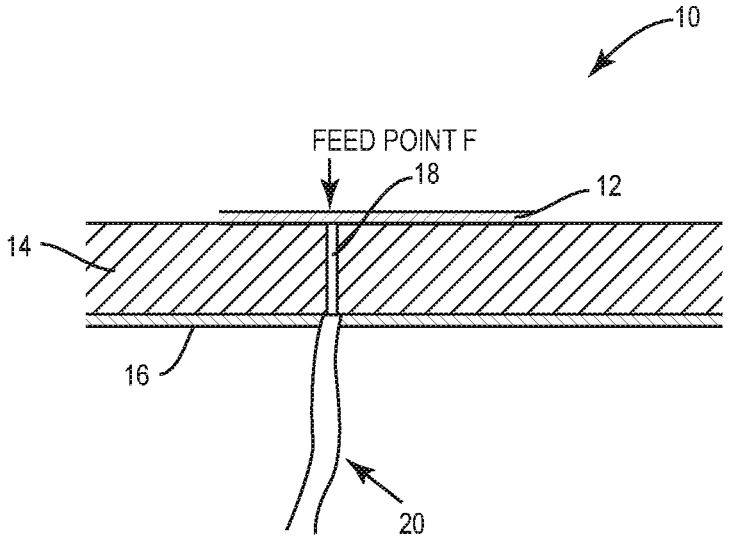
FIG. 1A (PRIOR ART)
FIGS. 1A and 1B show a conventional patch antenna construction and probe-fed feeding scheme.
Figure 1B:
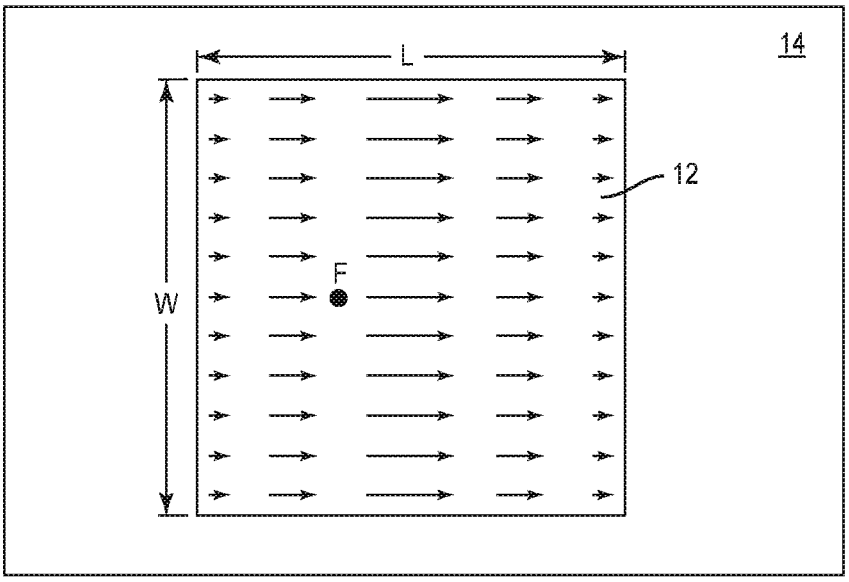
FIG. 1B (PRIOR ART)

It will be understood that for clear illustrations, FIGS. 1A-9 may not be drawn to scale.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Figure 2A:
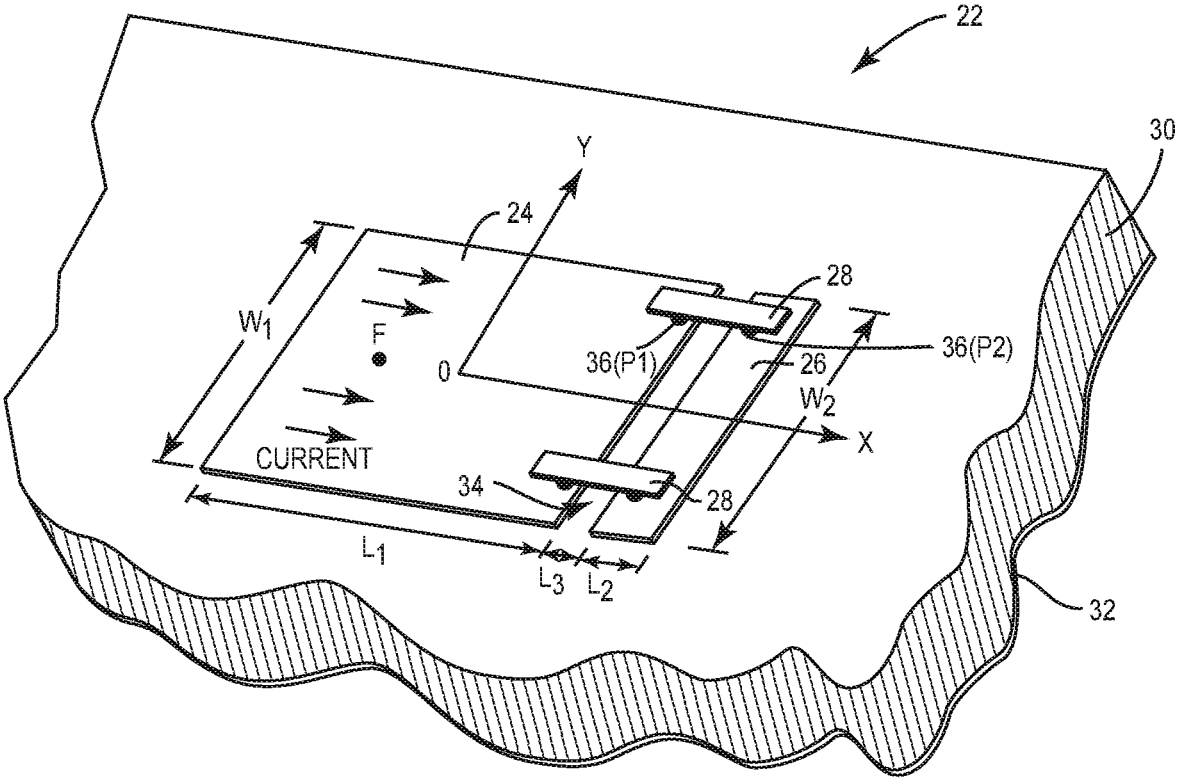
FIGS. 2A and 2B show an exemplary reconfigurable patch antenna according to one embodiment of the present disclosure.
Figure 2B:
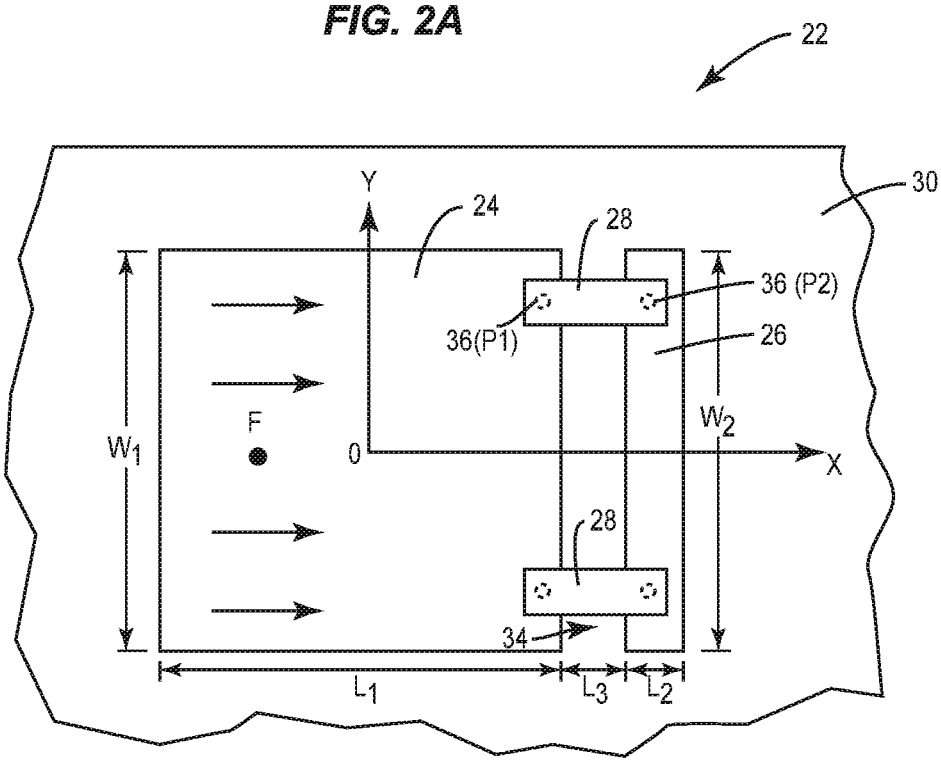

The present disclosure relates to a reconfigurable patch antenna and a reconfigurable phased array formed by a number of the reconfigurable patch antennas. FIG. 2A illustrates a three-dimensional (3D) version of an exemplary reconfigurable patch antenna 22, and FIG. 2B illustrates a top version of the exemplary reconfigurable patch antenna 22 according to one embodiment of the present disclosure. The reconfigurable patch antenna 22 includes a primary patch 24, a first extension patch 26, first switching components 28, a substrate 30, and a ground plane 32. Although various feed techniques, such as coaxial feed (i.e. probe-fed) technique, microstrip line feed technique, aperture coupled technique, and proximity coupled technique may be used in the reconfigurable patch antenna 22, the following embodiments incorporate the probe-fed technique (the feed probe and feedline used in the probe-fed technique are not shown) as an exemplary feed technique. Herein, a feed point F indicates the location of the feed probe and feedline, and is configured to receive a radio frequency (RF) signal for the primary patch 24.

In detail, the primary patch 24 and the first extension patch 26 are formed on a top surface of the substrate 30, while the ground plane 32 is formed on a bottom surface of the substrate 30. The primary patch 24 and the first extension patch 26 may be formed of micro metal strips, the substrate 30 may be formed of laminate, and the ground plane 32 may be formed of a metal sheet. In one embodiment, the primary patch 24 and the first extension patch 26 have rectangular shapes. The primary patch 24 has a width $W_1$ along a Y axis and a length $L_1$ along an X axis that is orthogonal to the Y axis. The origin point "0" of the X-Y axes is centered along both the width $W_1$ and the length $L_1$ of the primary patch 24. The first extension patch 26 has a width $W_2$ along the Y axis and a length $L_2$ along the X axis. The width $W_2$ of the first extension patch 26 and the width $W_1$ of the primary patch 24 are essentially the same, while the length $L_2$ of the first extension patch 26 and the length $L_1$ of the primary patch 24 may be essentially the same or different. The feed point F is an inner point on the primary patch 24, centered along the width $W_1$ of the primary patch 24 (on the X axis), and off-centered along the length $L_1$ of the primary patch 24 (not on the Y axis). As such, current on the primary patch 24 will flow along the length $L_1$ of the primary patch 24. In different applications, different shapes, such as square, circular, elliptical, or other continuous shapes, may be applicable to the primary patch 24 and the first extension patch 26.

The first extension patch 26 is parallel with the primary patch 24, and the width $W_2$ of the first extension patch 26 is symmetrical in respect to the X axis. There is a first gap 34 with a length $L_3$ between the primary patch 24 and the first extension patch 26. Note that, the feed point F is still centered along a width (on the X axis) of a combination of the primary patch 24 and the first extension patch 26, and is off-centered along a length ($L_1+L_2+L_3$) of the combination of the primary patch 24 and the first extension patch 26. In some applications, the first extension patch 26 and the feed point F may be located opposite in respect to the Y axis. In some applications, the first extension patch 26 and the feed point F may be located at a same side of the Y axis (not shown).

Herein, the patch antenna 22 includes two first switching components 28, and each first switching component 28 is formed across the first gap 34 and coupled to both the primary patch 24 and the first extension patch 26. The two first switching components 28 may be located symmetrically in respect to the X axis. The first switching components 28 are configured to connect the primary patch 24 and the first extension patch 26, or disconnect the primary patch 24 from the first extension patch 26. The first switching components 28 may be any types of switches, such as single pole single throw (SPST) switches, silicon on insulator (SOI) switches, microelectromechanical systems (MEMS) switches, mechanical switches, or PIN diode switches.

In one embodiment, each first switching component 28 includes a single switch, which has at least a first port terminal P1 and a second port terminal P2 coupled to the primary patch 24 and the first extension patch 26, respectively, through first bumps 36 (only one first bump is labeled with a reference number for clarity). The first bump 36 coupled to the primary patch 24 is configured to transfer the RF signal from the primary patch 24 to the first port terminal P1 of the first switching component 28. The first bump 36 coupled to the first extension patch 26 is configured to transfer the RF signal from the second port terminal P2 of the first switching component 28 to the first extension patch 26. Herein and hereafter, two first bumps 36, one of which is coupled to the primary patch 24 and another of which is coupled to the first extension patch 26, represents one switch.

The range of the length $L_3$ of the first gap 34 is driven by the packaging considerations, the bump spacing in the first switching components 28, the physical characteristics of the switching components 28, and manufacturing limitations of the laminate, on which the primary patch 24 and the first extension patch 26 are fabricated. The length $L_3$ of the first gap 34 is between 40 μm and 300 μm.

By opening or closing the first switching components 28, the primary patch 24 is disconnected or connected to the first extension patch 26, respectively. When the primary patch 24 is disconnected to the first extension patch 26, a first resonant frequency $f_{R1}$ of the reconfigurable patch antenna 22 is:

$$f_{R1} \approx \frac{c}{2L_1\sqrt{\varepsilon_r\varepsilon_0\mu_0}} \tag{2}$$

When the primary patch 24 is connected to the first extension patch 26, a second resonant frequency $f_{R2}$ of the reconfigurable patch antenna 22 is:

$$f_{R2} \approx \frac{c}{2(L_1+L_2+L_3)\sqrt{\varepsilon_r\varepsilon_0\mu_0}} \tag{3}$$

where c is the speed of light, $L_1$ is the length of the primary patch 24, $L_2$ is the length of the first extension patch 26, $L_3$ is the length of the first gap 34, $\varepsilon_0$ and $\mu_0$ are the free space permittivity and permeability, respectively, and $\varepsilon_r$ is the effective relative permittivity. The length $L_1$ of the primary patch 24 and the length $L_2$ of the first extension patch 26 are driven by the desired resonant frequencies. It is clear that the first switching components 28 are configured to tune an effective length of the reconfigurable patch antenna 22, so as to tune the resonant frequencies of the reconfigurable patch antenna 22. The reconfigurable patch antenna 22 provides tunable resonant frequencies using a same hardware.

Figure 3A:
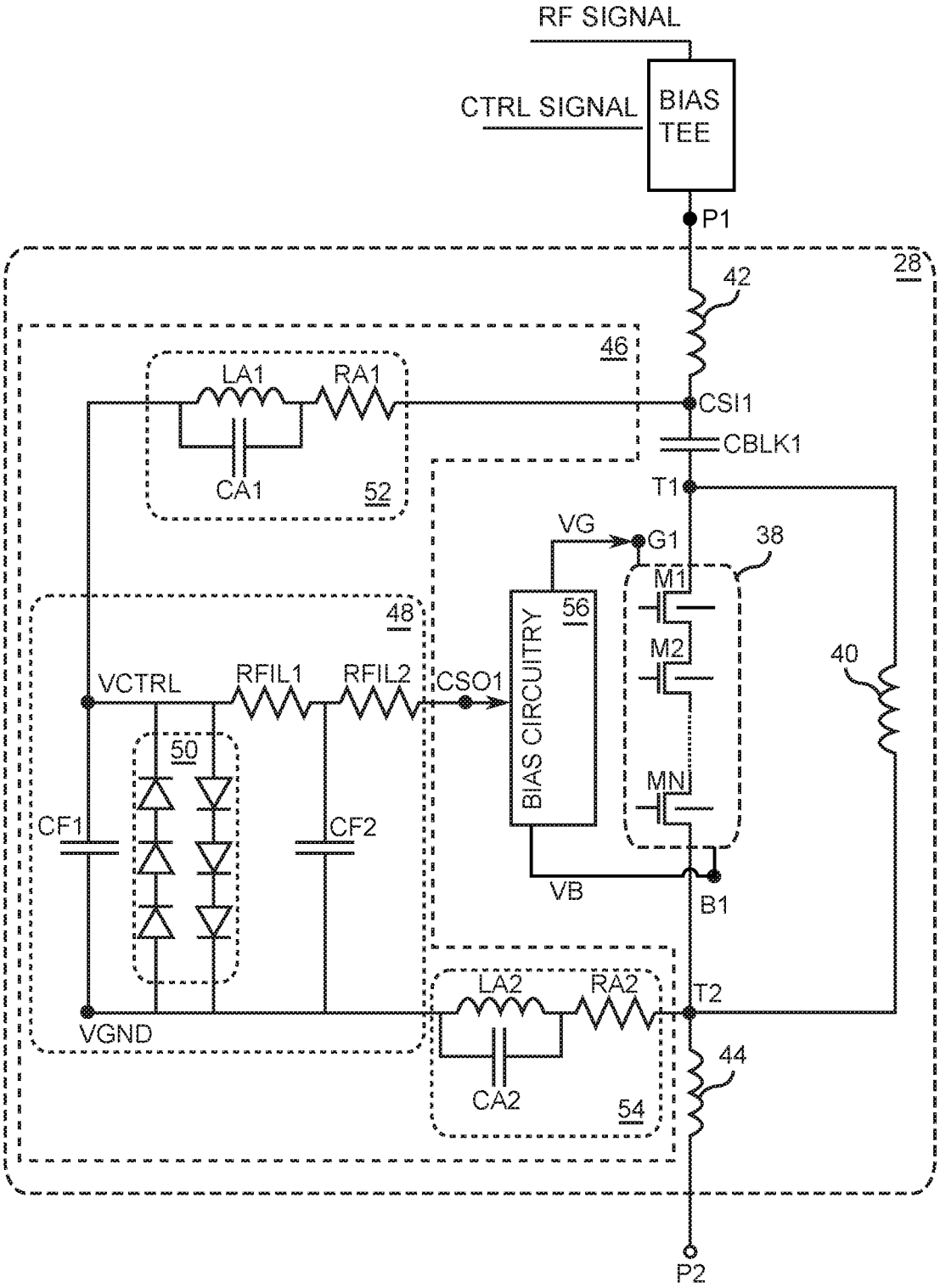
FIGS. 3A and 3B show an exemplary schematic of a switching component included in the reconfigurable patch antenna shown in FIG. 2B.

FIG. 3A is an exemplary schematic of the first switching component 28. A first port terminal P1 of the first switching component 28 is configured to receive the RF signal coupled with a control signal (non-zero voltage), which controls to open or close the first switching component 28. In some applications, there may be a bias tee that is placed before the first port terminal P1 to combine the RF signal with the control signal. The first switching component 28 includes a switch branch 38, an isolation inductor 40, a first port inductor 42, a second port inductor 44, and control signal decoupling circuitry 46.

Figure 3B:
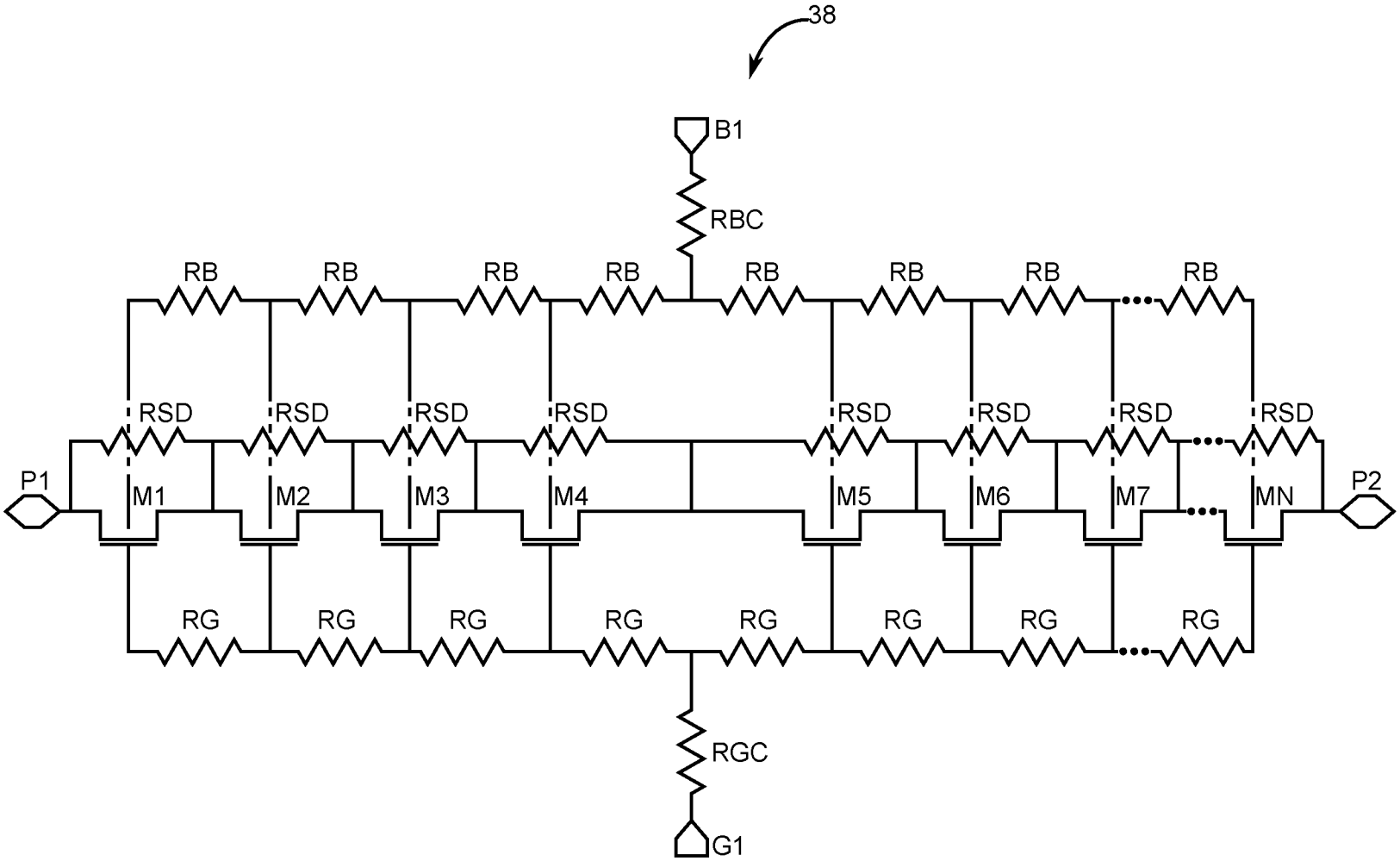

The switch branch 38 has a first branch terminal T1 coupled to the first port terminal P1 through the first port inductor 42, and a second branch terminal T2 coupled to a second port terminal P2 through the second port inductor 44. FIG. 3B shows details of the switch branch 38. The switch branch 38 is made up of a series-coupled stack of field-effect transistors M1 through MN. A source-to-drain resistor network is made up of source-to-drain resistors RSD, each of which is coupled from source-to-drain across each of the field-effect transistors M1 through MN. A gate resistor network is made up of gate resistors RG that are coupled between gates of adjacent ones of the field-effect transistors M1 through MN. A body resistor network is made up of body resistors RB coupled to body terminals of the field-effect transistors M1 through MN. Herein, N is a finite whole counting number.

A gate terminal G1 is coupled to the gate resistor network through a common gate resistor RGC, and a body terminal B1 is coupled to the body resistor network through a common body resistor RBC, each of which receives a bias voltage to control an on-state for passing a radio frequency signal between a first port terminal P1 and a second port terminal P2 and an off-state that prevents passage of the radio frequency signal between the first port terminal P1 and the second port terminal P2. Table 1, below, lists some typical bias values (in volts) for a gate bias voltage VG and a body bias voltage VB that are applied to the gate terminal G1 and body terminal B1, respectively. In the on-state, the source, drain, and body bias voltages are set to 0 volts and the gate is biased to 2.5 volts. In the off-state, the source and drain are biased to 0 volts, but the body and gate are both set to −2.5 volts, e.g., strongly off. The body is sometimes referred to as "the bulk."

TABLE 1

| Switch Mode | VG (Gate Voltage) | VB (Body Voltage) | VS/VD (Source/Drain Voltage) |
|---|---|---|---|
| On-state | 2.5 V | 0 V | 0 V |
| Off-state | −2.5 V | −2.5 V | 0 V |

It is to be understood that the switch branch 38 can be based upon silicon-on-insulator technology and high electron mobility technology.

The switch branch 38 has both an on-state and an off-state to control passage of the RF signal between the first port terminal P1 and the second port terminal P2 in response to the gate bias voltage VG applied to the gate terminal G1. In this exemplary embodiment, whenever the gate bias voltage VG is positive, channels of the field-effect transistors M1 through MN become conductive, placing the switch branch 38 into the on-state. When the gate bias voltage VG is negative, channels of the field-effect transistors M1 through MN become non-conductive, placing the switch branch 38 into the off-state.

The control signal decoupling circuitry 46 has a control signal input terminal CSI1 coupled to the first port terminal P1 (through the first port inductor 42) to receive the composite signal, and a control signal output terminal CSO1. Herein, the control signal decoupling circuitry 46 is configured to decouple the control signal from the RF signal. Moreover, a direct current blocking capacitor CBLK1 may be coupled between the control signal input terminal CSI1 and the first branch terminal T1 to block the control signal from entering the switch branch 38 through the first branch terminal T1.

In this particular embodiment, the control signal decoupling circuitry 46 includes control signal conditioning circuitry 48 that is configured to filter the RF signal from the control signal. The control signal conditioning circuitry 48 is coupled between a control voltage input terminal VCTRL and a ground voltage terminal VGND. In this exemplary embodiment, a first low-pass filter is made up of a first filter resistor RFIL1 coupled between the control voltage input terminal VCTRL and the control signal output terminal CSO1 and a first filter capacitor CF1 coupled between the control voltage input terminal VCTRL and the ground voltage terminal VGND. A second low pass filter is made up of a second filter resistor RFIL2 coupled between the first filter resistor RFIL1 and the control signal output terminal CSO1 and a second filter capacitor CF2 coupled between the ground voltage terminal VGND and a node shared by the first filter resistor RFIL1 and the second filter resistor RFIL2.

Electrostatic discharge (ESD) shunting diodes 50 coupled between the control voltage input terminal VCTRL and the ground voltage terminal VGND are configured to shunt energy of an ESD event away from the switch branch 38. In the exemplary configuration of FIG. 3A, the ESD shunting diodes 50 are arranged in two antiparallel branches that each include three of the ESD shunting diodes 50 coupled in series.

Further included in the control signal decoupling circuitry 46 is a first RF attenuating branch 52 coupled between the control voltage input terminal VCTRL and the control signal input terminal CSI1 to present impedance to the RF signal within a first path that includes the control signal conditioning circuitry 48. The first RF attenuating branch 52 may include a first attenuating resistor RA1 and/or a first attenuating inductor LA1 coupled between the control voltage input terminal VCTRL and the control signal input terminal CSI1. Moreover, a first attenuating capacitor CA1 may be coupled in parallel with the first attenuating inductor LA1 to provide a notch filter to further attenuate the RF signal without appreciably attenuating the control signal.

Even further included in the control signal decoupling circuitry 46 is a second RF attenuating branch 54 coupled between the ground voltage terminal VGND and the second branch terminal T2 to present impedance to the RF signal within a second path that includes the control signal conditioning circuitry 48. The second RF attenuating branch 54 may include a second attenuating resistor RA2 and/or a second attenuating inductor LA2 coupled between the ground voltage terminal VGND and the second branch terminal T2. Moreover, a second attenuating capacitor CA2 may be coupled in parallel with the second attenuating inductor LA2 to provide a notch filter to further attenuate the RF signal to prevent the RF signal from being applied to the control signal output terminal CSO1. In an exemplary embodiment, the first attenuating inductor LA1 and the second attenuating inductor LA2 each have an inductance value of 2.84 nH to provide an impedance of 500Ω for an RF signal having a frequency of 28 GHz. In some embodiments, the first RF attenuating branch 52 and the second RF attenuating branch 54 each provide impedance to the RF signal that is at least an order of magnitude greater than the impedance to the RF signal due to either of the first port inductor 42 or the second port inductor 44.

Bias circuitry 56 is coupled between the control signal output terminal CSO1 and the gate terminal G1 and, in this exemplary embodiment, a body terminal B1. The bias circuitry 56 biases both the bodies and the gates of the stack of field-effect transistors M1 through MN that make up the switch branch 38 in this particular embodiment. Responsive to the control signal, the gate bias voltage VG is applied to the gate terminal G1 and the body bias voltage VB is applied to the body terminal B1. In some applications, the isolation inductor 40 is coupled between the first branch terminal T1 and the second branch terminal T2 of the switch branch 38. The isolation inductor 40 has a given inductance that provides resonance with a total off-state capacitance of the switch branch 38 at a center frequency of the RF signal that is within a frequency range from 26 GHz to 66 GHz. In some applications, the first switching component 28 may not include the isolation inductor 40.

In this configuration, the first switching component 28 may be considered as a two-terminal component because only the first port terminal P1 and the second port terminal P2, with the exception of perhaps ground, are external to the first switching component 28. In some applications, if the first switching component 28 has no extra terminal (besides the first and second terminals P1 and P2) coupled to ground, the ground voltage terminal VGND of the control signal conditioning circuitry 48 is not grounded, but is coupled to the second branch terminal T2 of the switch branch 38. In addition, the first extension patch 26 may be coupled to ground through a high value resistor or inductor (not shown). As such, the composite signal at the first port terminal P1 of the first switching component 28 is a combination of the RF signal and a non-zero voltage control signal, while the composite signal at the second port terminal P2 of the first switching component 28 is a combination of the RF signal and a grounded voltage.

Herein, if the primary patch 24 receives a non-zero voltage (a positive or a negative voltage), and an RF signal at the feed point F and the first extension patch 26 is grounded, the primary patch 24 may be coupled to the first port terminal P1 of the first switching component 28 and the first extension patch 26 may be coupled to the second port terminal P2 of the first switching component 28. If the primary patch 24 receives an RF signal and a grounded voltage (0 V) at the feed point F and the first extension patch 26 is set to a non-zero voltage (a positive or a negative voltage), the primary patch 24 may be coupled to the second port terminal P2 of the first switching component 28 and the first extension patch 26 may be coupled to the first port terminal P1 of the first switching component 28.

Figure 4:
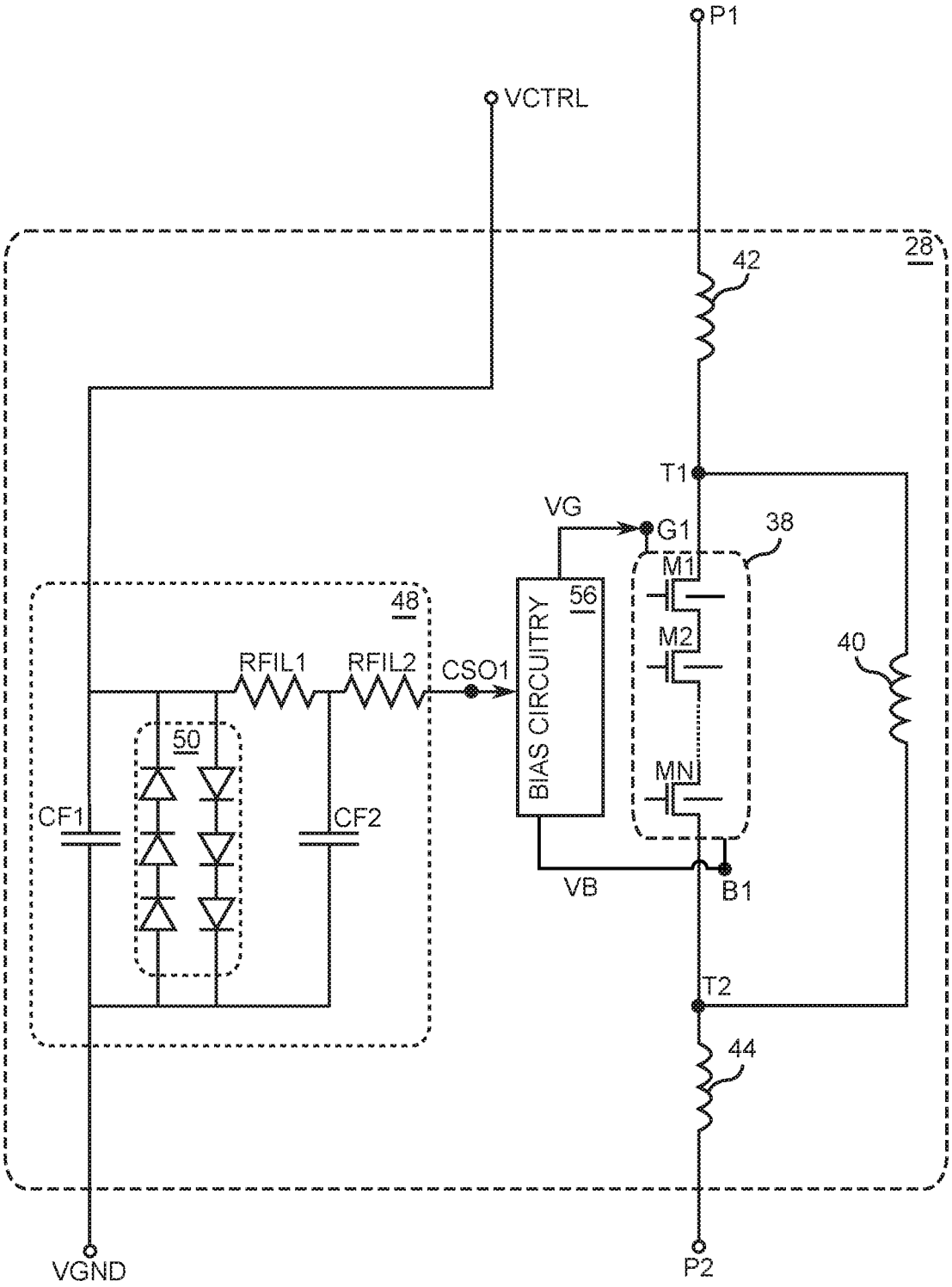
FIG. 4 show an exemplary schematic of a switching component included in the reconfigurable patch antenna shown in FIG. 2B.

In some applications, beside the first port terminal P1 and the second port terminal P2, the first switching component 28 may include a control voltage input terminal VCTRL and a ground voltage terminal VGND as shown in FIG. 4. Herein, the first port terminal P1 and the second port terminal P2 are coupled to the primary patch 24 and the first extension patch 26, respectively, through the first bumps 36; while the control voltage input terminal VCTRL and the ground voltage terminal VGND may be not coupled to the primary patch 24 or the first extension patch 26 (not shown).

In this particular embodiment, the control signal may be provided directly from the control voltage input terminal VCTRL, thereby eliminating a need for the first RF attenuating branch 52 and the second RF attenuating branch 54. However, this reduction comes at a cost of increased pin count over the exemplary embodiment of FIG. 3A. The control signal conditioning circuitry 48 remains to provide filtering to the control signal to reduce possible RF noise inadvertently coupled to the control signal. Furthermore, the ESD shunting diodes 50 coupled between the control voltage input terminal VCTRL and the ground voltage terminal VGND remain configured to shunt energy of an ESD event away from the switch branch 38. In some applications, the isolation inductor 40 is coupled between the first branch terminal T1 and the second branch terminal T2 of the switch branch 38. The isolation inductor 40 has a given inductance that provides resonance with a total off-state capacitance of the switch branch 38 at a center frequency of the RF signal that is within a frequency range from 26 GHz to 66 GHz. In some applications, the first switching component 28 may not include the isolation inductor 40.

Figure 5:
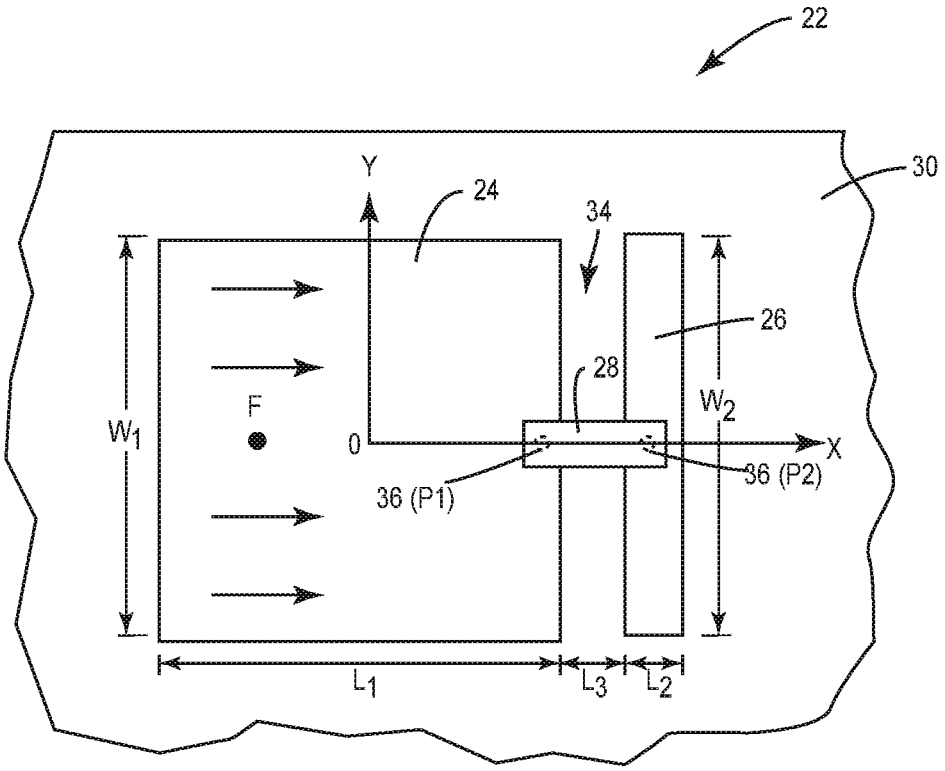
FIGS. 5-8 show an alternative reconfigurable patch antenna according to one embodiment of the present disclosure.
Figure 6:
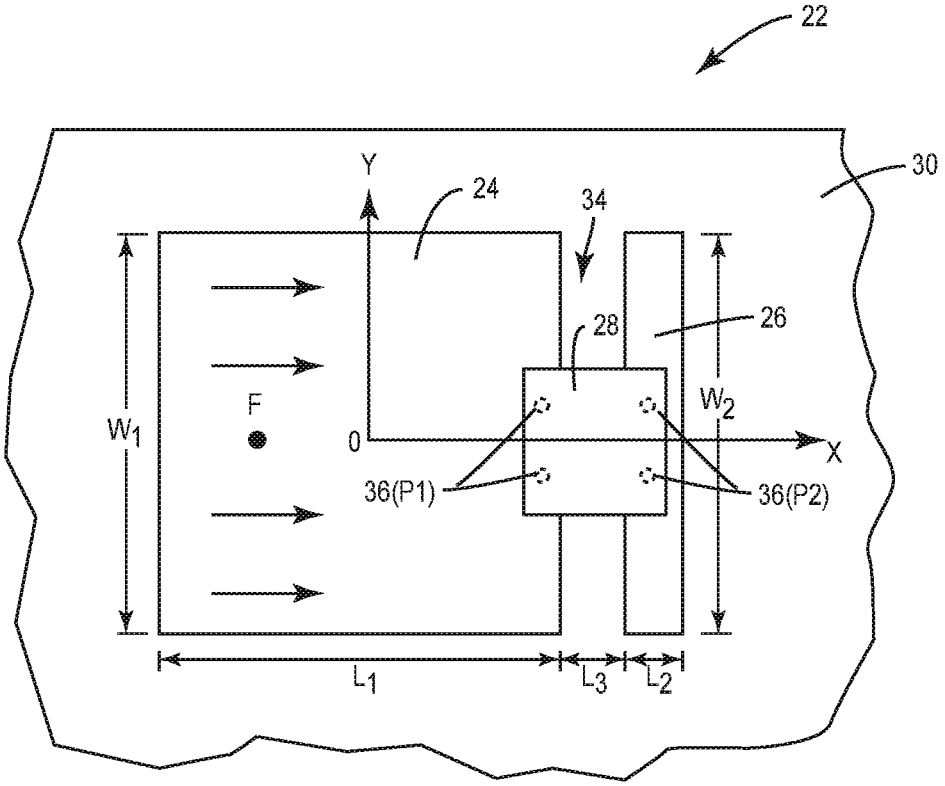

In different applications, the reconfigurable patch antenna 22 may utilize fewer or more first switching components 28 between the primary patch 24 and the first extension patch 26. As shown in FIG. 5, a single first switching component 28, instead of the two first switching components 28 is formed across the first gap 34 and coupled to both the primary patch 24 and the first extension patch 26. The single first switching component 28 may be on or off (not shown) the X axis. In some applications, the single first switching component 28 may include two or more switches instead of a single switch, as illustrated in FIG. 6. The multiple switches of the single first switching component 28 may be located symmetrically in respect to the X axis.

Figure 7A:
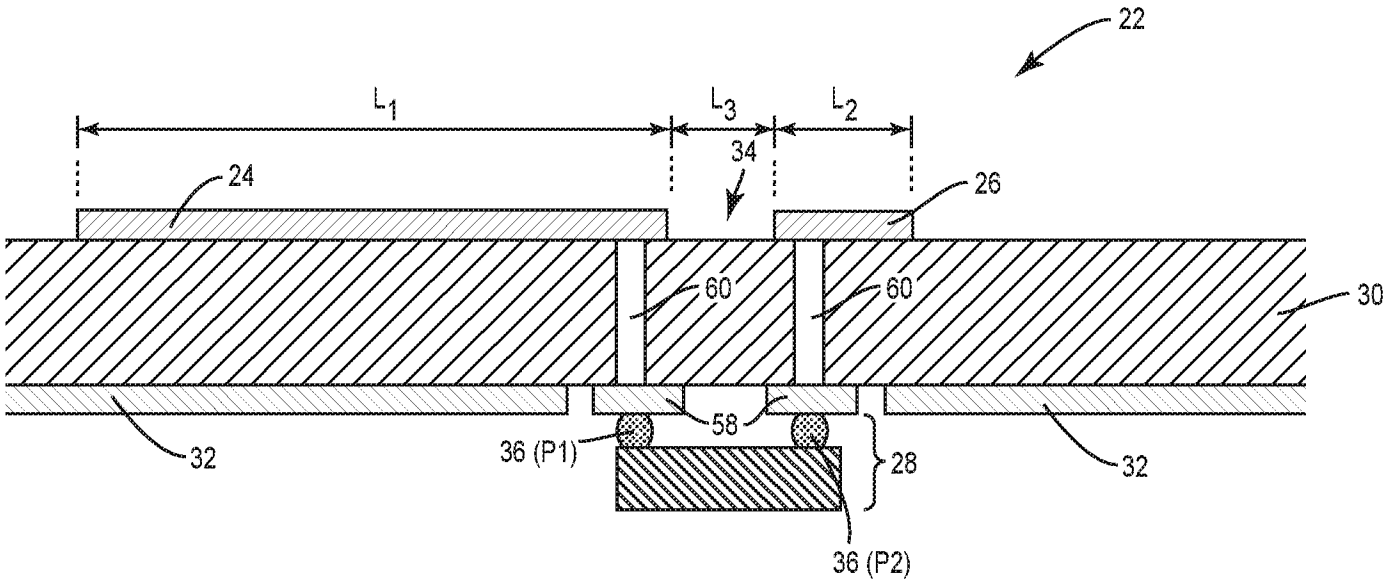
Figure 7B:
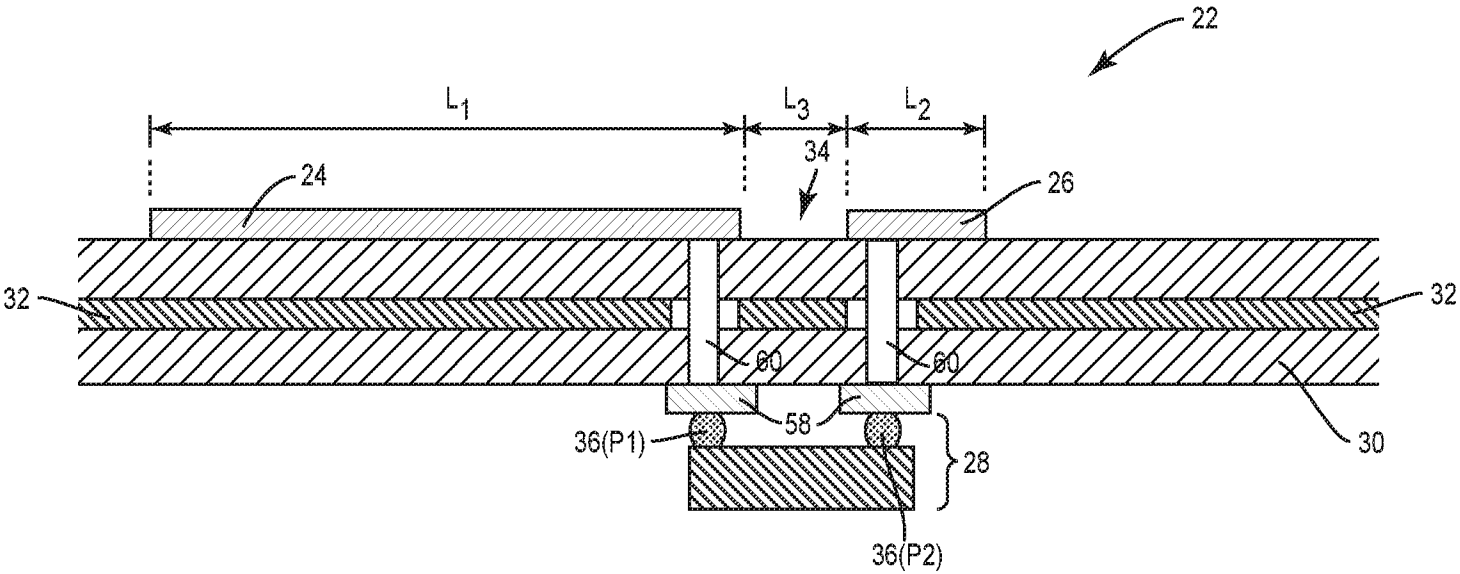

As shown in FIGS. 2A, 2B, 5, and 6, the first switching component(s) 28 is formed over the primary patch 24 and the first extension patch 26, consequently residing over the top surface of the substrate 30. Alternatively, in some applications, the first switching component(s) 28 resides underneath the substrate 30, as illustrated in FIG. 7A. The reconfigurable patch antenna 22 may further include substrate pads 58 and substrate vias 60. The substrate pads 58 are formed on the bottom surface of the substrate 30, separate from each other and separate from the ground plane 32. Each substrate via 60 extends through the substrate 30 and connects the primary patch 24 or the first extension patch 26 to a corresponding substrate pad 58. In some applications, the ground plane 32 may be formed within the substrate 30 as illustrated in FIG. 7B. Each substrate via 60 is separate from the ground plane 32.

In one embodiment, the first port terminal P1 (associated with its first bump 36) of the first switching component 28 is coupled to the primary patch 24 through the corresponding substrate pad 58 and substrate via 60. The second port terminal P2 (associated with its first bump 36) of the first switching component 28 is coupled to the first extension patch 26 through the corresponding substrate pad 58 and substrate via 60. As such, the first switching component 28 is still across the first gap 34 and electrically coupled to both the primary patch 24 and the first extension patch 26. Herein, the first switching component 28 may include an extra terminal (not shown) configured to receive the switching control signal that controls the first switching component 28 when to open and when to close. The first switching component 28 may also include an extra terminal (not shown) configured to be grounded.

Figure 8:
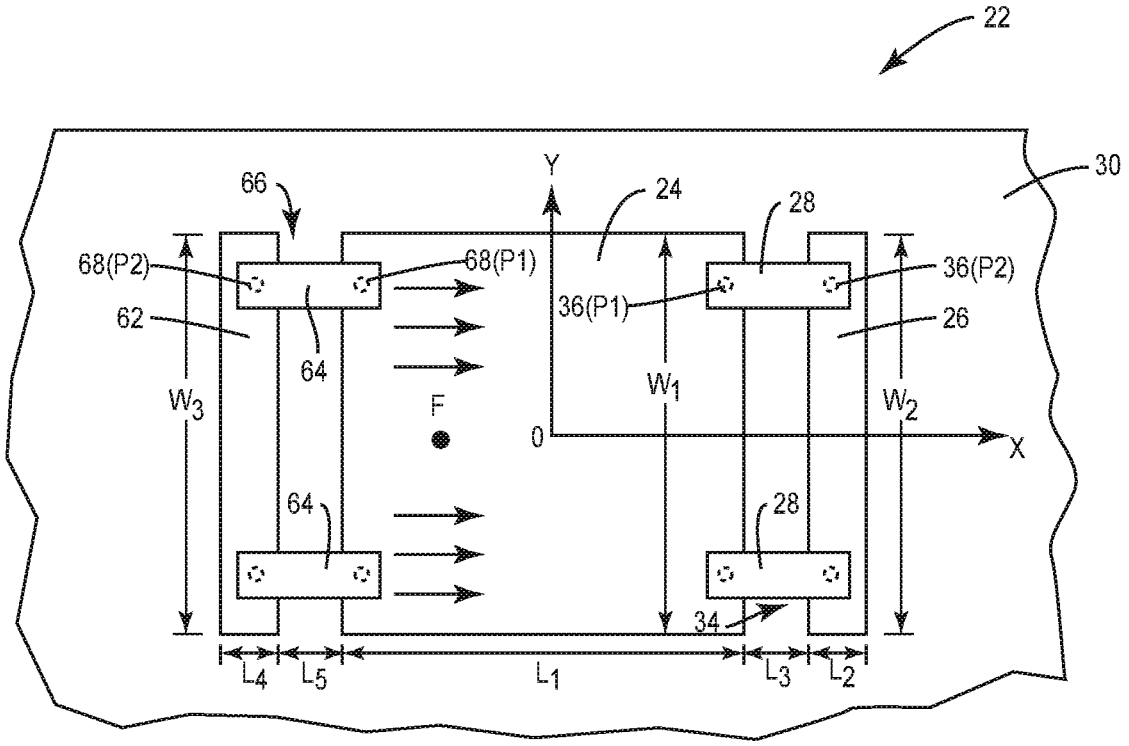

In some applications, the reconfigurable patch antenna 22 may include more than one extension patch, as illustrated in FIG. 8. In this embodiment, the reconfigurable patch antenna 22 further includes a second extension patch 62 and second switching components 64. The second extension patch 62 resides on the top surface of the substrate 30 and may be formed of a micro metal strip with a rectangular shape. The second extension patch 62 has a width $W_3$ along the Y axis and a length $L_4$ along the X axis. The width $W_1$ of the primary patch 24, the width $W_2$ of the first extension patch 26, and the width $W_3$ of the second extension patch 62 are essentially the same. The length $L_1$ of the primary patch 24, the length $L_2$ of the first extension patch 26, and the length $L_4$ of the second extension patch 62 may be essentially the same or different. For instance, the length $L_4$ of the second extension patch 62 is essentially the same as the length $L_2$ of the first extension patch 26, but different from the length $L_1$ of the primary patch 24. Or, the length $L_1$ of the primary patch 24, the length $L_2$ of the first extension patch 26, and the length $L_3$ of the second extension patch 62 are different from each other. Herein, the second extension patch 62 is also parallel with the primary patch 24 and opposite to the first extension patch 26. The width $W_3$ of the second extension patch 62 is symmetrical in respect to the X axis. There is a second gap 66 with a length $L_5$ between the primary patch 24 and the second extension patch 62. The second gap 66 and the first gap 34 may have essentially a same size ($L_3$=$L_5$).

Note that, the location of the feed point F is centered along a width (on the X axis) of a combination of the primary patch 24, the first extension patch 26, and the second extension patch 62. In addition, the feed point F is required to be off-centered along the length $L_1$ of the primary patch 24, off-centered along the length ($L_1$+$L_2$+$L_3$) of the combination of the primary patch 24 and the first extension patch 26, off-centered along a length ($L_1$+$L_4$+$L_5$) of the combination of the primary patch 24 and the second extension patch 62, and off-centered along a length ($L_1$+$L_2$+$L_3$+$L_4$+$L_5$) of the combination of the primary patch 24, the first extension patch 26, and the second extension patch 62.

Each second switching component 64 is formed across the second gap 66 and coupled to both the primary patch 24 and the second extension patch 62. The second switching components 64 may be located symmetrically in respect to the X axis. The second switching components 64 are configured to connect the primary patch 24 and the second extension patch 62, or disconnect the primary patch 24 from the second extension patch 62. The second switching components 64 may be any types of switches, such as single pole single throw (SPST) switches, silicon on insulator (SOI) switches, microelectromechanical systems (MEMS) switches, mechanical switches, or PIN diode switches.

In one embodiment, each second switching component 64 includes a single switch, which has at least one a first port terminal P1 and a second port terminal P2 coupled to the primary patch 24 and the first extension patch 26, respectively, through second bumps 68. The second bump 68 coupled to the primary patch 24 is configured to transfer the RF signal from the primary patch 24 to the first port terminal P1 of the second switching component 64. The second bump 68 coupled to the second extension patch 62 is configured to transfer the RF signal from the second port terminal P2 of the second switching component 64 to the second extension patch 62. In some applications, each second switching component 64 may include extra terminals (not shown). For instance, one extra terminal is configured to receive a switching control signal that controls when to open and when to close the first switching component 28. Another extra terminal is configured to be grounded. In some applications, each second switching component 64 only has the first port terminal P1 and the second port terminal P2. Both the RF signal and the control signal are received at the feed point F, and transferred from the primary patch 24 to the first port terminal P1 of the second switching component 64.

In order to connect the first and second extension patches 26 and 62 independently, a voltage difference between the primary patch 24 and the first extension patch 26 and a voltage difference between the primary patch 24 and the second extension patch 62 may be different. Herein, one may set the first and second extension patches 26 and 62 into different voltages.

If the first switching component 28 and the second switching component 64 are two-terminal components, the first port terminal P1 of the first/second switching component 28/64 is connected to a patch that is set to a non-zero voltage, while the second port terminal P2 of the first/second switching component 28/64 is connected to a patch that is grounded. As such, the first port terminal P1 of the first switching component 28 may be coupled to the primary patch 24 or the first extension patch 26, and the second port terminal P2 of the first switching component 28 may be coupled to the primary patch 24 or the first extension patch 26. Similarly, the first port terminal P1 of the second switching component 64 may be coupled to the primary patch 24 or the second extension patch 62, and the second port terminal P2 of the second switching component 64 may be coupled to the primary patch 24 or the second extension patch 62.

By opening or closing the first switching components 28 and the second switching components 64, the reconfigurable patch antenna 22 is configured to provide different resonant frequencies. When the primary patch 24 is disconnected to the first extension patch 26 and disconnected to the second extension patch 62 (both the first switching components 28 and the second switching components 64 are open), a first resonant frequency $f_{R1}$ of the reconfigurable patch antenna 22 is:

$$f_{R1} \approx \frac{c}{2L_1\sqrt{\varepsilon_r\varepsilon_0\mu_0}} \tag{4}$$

When the primary patch 24 is connected to the first extension patch 26 and disconnected to the second extension patch 62, a second resonant frequency $f_{R2}$ of the reconfigurable patch antenna 22 is:

$$f_{R2} \approx \frac{c}{2(L_1 + L_2 + L_3)\sqrt{\varepsilon_r\varepsilon_0\mu_0}} \tag{5}$$

When the primary patch 24 is disconnected to the first extension patch 26 and connected to the second extension patch 62, a third resonant frequency $f_{R3}$ of the reconfigurable patch antenna 22 is:

$$f_{R3} \approx \frac{c}{2(L_1 + L_4 + L_5)\sqrt{\varepsilon_r\varepsilon_0\mu_0}} \tag{6}$$

When the primary patch 24 is connected to both the first extension patch 26 and the second extension patch 62, a fourth resonant frequency $f_{R4}$ of the reconfigurable patch antenna 22 is:

$$f_{R4} \approx \frac{c}{2(L_1 + L_2 + L_3 + L_4 + L_5)\sqrt{\varepsilon_r\varepsilon_0\mu_0}} \tag{7}$$

where c is the speed of light, $L_1$ is the length of the primary patch 24, $L_2$ is the length of the first extension patch 26, $L_3$ is the length of the first gap 34, $L_4$ is the length of the second extension patch 62, $L_5$ is the length of the second gap 66, $\varepsilon_0$ and $\mu_0$ are the free space permittivity and permeability, respectively, and $\varepsilon_r$ is the effective relative permittivity. It is clear that the first switching components 28 and the second switching components 64 are configured to tune an effective length of the reconfigurable patch antenna 22, so as to tune the resonant frequencies of the reconfigurable patch antenna 22. The reconfigurable patch antenna 22 provides tunable resonant frequencies using a same hardware.

Figure 9:
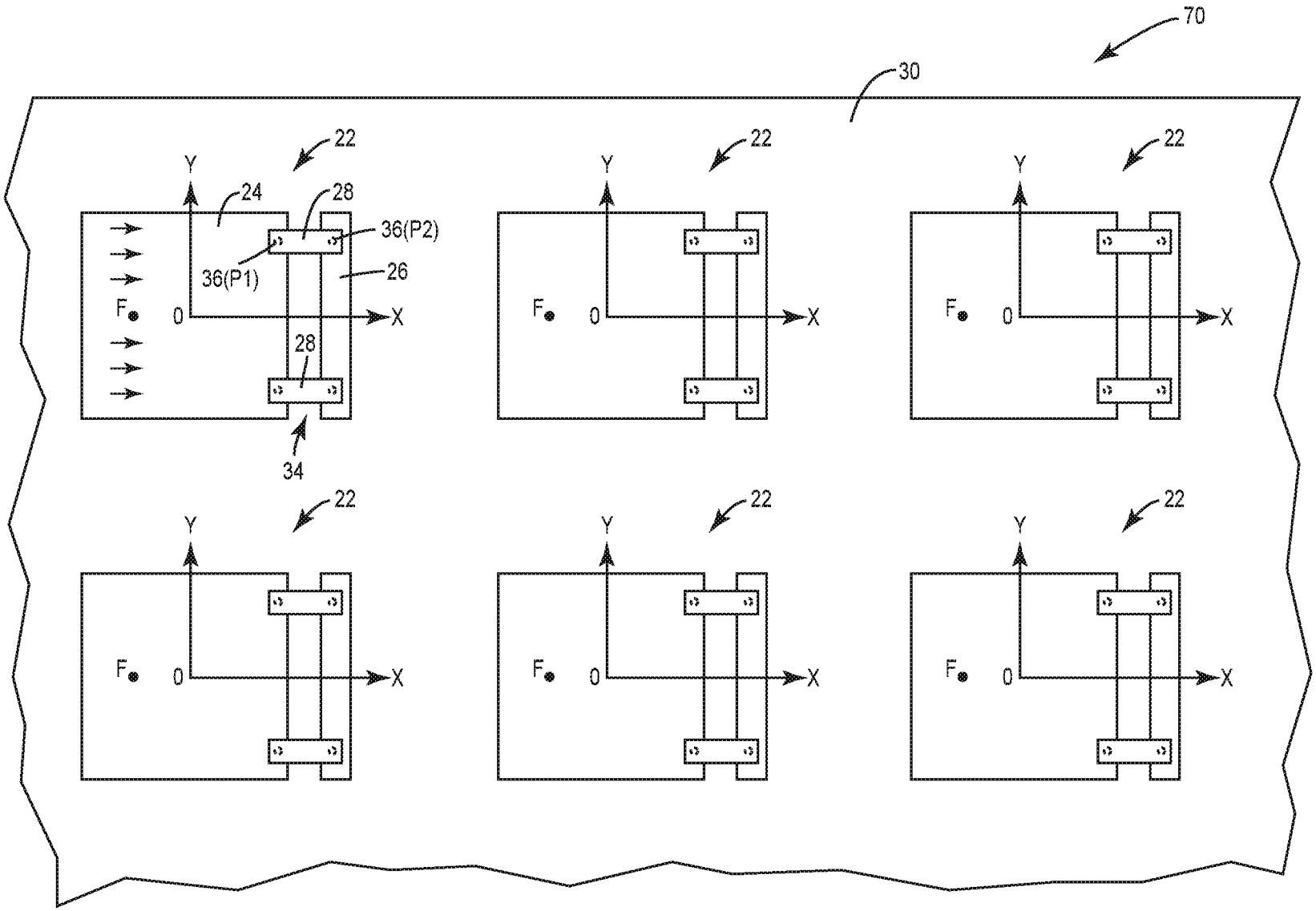
FIG. 9 shows an exemplary reconfigurable phased array formed by the reconfigurable patch antenna shown in FIG. 2B.

FIG. 9 shows an exemplary reconfigurable phased array 70 formed by the reconfigurable patch antennas 22 shown in FIG. 2B. For the purpose of this illustration, the reconfigurable phased array 70 includes six reconfigurable patch antennas 22, which are arranged in a 2×3 configuration and share a common substrate 30. In different applications, the reconfigurable phased array 70 may include fewer or more reconfigurable patch antennas. Herein, each reconfigurable patch antenna 22 has a same configuration with the same primary patch 24, the same first extension patch 26, the same the first switching components 28, and the same first gap 34. In addition, each reconfigurable patch antenna 22 will be excited at a same resonant frequency and with a phase difference in between the adjacent ones. By opening or closing the switches of the first switching components 28 in each reconfigurable patch antenna 22, the reconfigurable phased array 70 is configured to provide different resonant frequencies.

Those skilled in the art will recognize improvements and modifications to the preferred embodiments of the present disclosure. All such improvements and modifications are considered within the scope of the concepts disclosed herein and the claims that follow.

What is claimed is:

1. An apparatus comprising:

a substrate having a top surface and a bottom surface;

a primary patch formed on the top surface of the substrate, wherein:

the primary patch has a width along a Y axis and a length along an X axis that is orthogonal to the Y axis, wherein an origin point of X-Y axes is centered along both the width and the length of the primary patch; and the primary patch has a feed point configured to receive a radio frequency (RF) signal, wherein the feed point is centered along the width of the primary patch, and off-centered along the length of the primary patch;

a first extension patch formed on the top surface of the substrate and parallel to the primary patch, wherein a first gap is formed between the first extension patch and the primary patch; and at least one first switching component formed across the first gap, electrically coupled to both the primary patch and the first extension patch, and configured to connect the primary patch to the first extension patch or disconnect the primary patch from the first extension patch, wherein:

the at least one first switching component comprises a first port terminal coupled to the primary patch, a second port terminal coupled to the first extension patch, control signal conditioning circuitry, and a switch branch;

the switch branch has a first branch terminal coupled to the first port terminal and a second branch terminal coupled to the second port terminal;

the switch branch is configured to pass the RF signal between the first branch terminal and the second branch terminal in an on-state and configured to block the RF signal from passing between the first branch terminal and the second branch terminal in an off-state in response to a control signal provided by the control signal conditioning circuitry; and the control signal conditioning circuitry is configured to provide filtering to the control signal.

2. The apparatus of claim 1 wherein the at least one first switching component is one of a group consisting of a single pole single throw (SPST) switch, a silicon on insulator (SOI) switch, a microelectromechanical systems (MEMS) switch, a mechanical switch, and a PIN diode switch.

3. The apparatus of claim 1 wherein the at least one first switching component comprises a single switch.

4. The apparatus of claim 1 wherein the at least one first switching component comprises a plurality of switches.

5. The apparatus of claim 1 wherein:

the first extension patch has a width along the Y axis and a length along the X axis;

the width of the primary patch and the width of the first extension patch have essentially a same value;

the width of the first extension patch is symmetrical in respect to the X axis; and the at least one first switching component is formed along the X axis.

6. The apparatus of claim 5 wherein the at least one first switching component comprises a first switching component on the X axis.

7. The apparatus of claim 5 wherein the at least one first switching component comprises a first switching component off the X axis.

8. The apparatus of claim 5 wherein the at least one first switching component comprises two first switching components, which are located symmetrically in respect to the X axis.

9. The apparatus of claim 1 wherein the at least one first switching component resides over the top surface of the substrate.

10. The apparatus of claim 1 further comprising a ground plane, wherein both the at least one first switching component and the ground plane are formed on the bottom surface of the substrate and separate from each other.

11. The apparatus of claim 10 wherein the primary patch and the first extension patch are coupled to the at least one first switching component by substrate vias, which extend through the substrate.

12. The apparatus of claim 1 further comprising a ground plane, wherein:

the at least one first switching component is formed on the bottom surface of the substrate; and the ground plane is formed within the substrate.

13. The apparatus of claim 12 wherein the primary patch and the first extension patch are coupled to the at least one first switching component by substrate vias, which extend through the substrate and are separate from the ground plane.

14. The apparatus of claim 1 further comprising:

a second extension patch formed over the top surface of the substrate, parallel to the primary patch, and opposite to the first extension patch, wherein a second gap is formed between the second extension patch and the primary patch; and at least one second switching component formed across the second gap, electrically coupled to both the primary patch and the second extension patch, and configured to connect the primary patch to the second extension patch or disconnect the primary patch from the second extension patch.

15. The apparatus of claim 14 wherein the first gap and the second gap have essentially a same size.

16. The apparatus of claim 14 wherein the feed point is centered along the width of the primary patch and off-centered along the length of the primary patch, wherein:

the first extension patch has a width along the Y axis and a length along the X axis;

the second extension patch has a width along the Y axis and a length along the X axis;

the width of the primary patch, the width of the first extension patch, and the width of the second extension patch have essentially a same value;

the width of the first extension patch is symmetrical in respect to the X axis;

the width of the second extension patch is symmetrical in respect to the X axis; and the at least one first switching component and the at least one second switching component are formed along the X axis.

17. The apparatus of claim 16 wherein the length of the primary patch, the length of the first extension patch, and the length of the second extension patch are different from each other.

18. The apparatus of claim 16 where the length of the first extension patch is essentially the same as the length of the second extension patch, and different from the length of the primary patch.

19. The apparatus of claim 1 wherein the at least one first switching component further comprises control signal decoupling circuitry, wherein:

the control signal is coupled with the RF signal and received at the first port terminal;

the switch branch further comprises a branch control terminal; and the control signal decoupling circuitry comprises a control signal input terminal coupled to the first port terminal to receive the control signal coupled to the RF signal, the control signal conditioning circuitry, and a control signal output terminal coupled to the branch control terminal, wherein the control signal conditioning circuitry is configured to filter the RF signal from the control signal and provide the control signal to the branch control terminal.

20. The apparatus of claim 1 wherein the at least one first switching component further comprises, a control voltage input terminal and a ground voltage terminal, which are not coupled to the primary patch or the first extension patch, wherein:

the control signal conditioning circuitry is coupled between the control voltage input terminal and the ground voltage terminal; and the first port terminal is configured to receive the RF signal from the primary patch, the second port terminal is configured to transmit the RF signal to the first extension patch, the control voltage input terminal is configured to receive the control signal, the ground voltage terminal is grounded, and the control signal conditioning circuitry is configured to provide filtering to the control signal to reduce RF noise.

* * * * *